US010670340B2

(12) United States Patent
Batscha et al.

(10) Patent No.: US 10,670,340 B2
(45) Date of Patent: Jun. 2, 2020

(54) COOLING WATER SUPPLY SYSTEM AND METHOD

(71) Applicant: ORMAT TECHNOLOGIES, Inc., Reno, NV (US)

(72) Inventors: Dany Batscha, Kiriat Ono (IL); Noa Kalish, Oranit (IL); Gal Yona, Mainz (DE); Idan Peled, Rehovot (IL); Avi Ben-Sabat, Tel-Aviv (IL); Ohad Rotem, Rehovot (IL)

(73) Assignee: ORMAT TECHNOLOGIES, Inc., Reno, NV (US)

( * ) Notice: Subject to any disclaimer, the term of this patent is extended or adjusted under 35 U.S.C. 154(b) by 644 days.

(21) Appl. No.: 14/556,761

(22) Filed: Dec. 1, 2014

(65) Prior Publication Data

US 2016/0153718 A1 Jun. 2, 2016

(51) Int. Cl.
*F28B 9/04* (2006.01)
*F28B 1/02* (2006.01)
(Continued)

(52) U.S. Cl.
CPC ..... *F28B 1/02* (2013.01); *F28B 9/06* (2013.01); *F28F 25/00* (2013.01); *F28F 27/003* (2013.01); *F28F 2025/005* (2013.01)

(58) Field of Classification Search
CPC .. Y10S 261/11; F28B 1/02; F28B 9/06; F28F 27/003; F28F 25/00; F28F 25/005; F28F 19/00; F28C 2001/006; H01F 27/16
See application file for complete search history.

(56) References Cited

U.S. PATENT DOCUMENTS 3,094,133 A * 6/1963 Treanor ..... C02F 1/688 137/101.11
4,475,356 A * 10/1984 Lewis ..... F28F 25/00 62/183

(Continued)

FOREIGN PATENT DOCUMENTS

WO WO 2009/063051 A1 5/2009

OTHER PUBLICATIONS

International Search Report dated May 26, 2016 in PCT/IB 15/02268.

(Continued)

*Primary Examiner* — Frantz F Jules
*Assistant Examiner* — Martha Tadesse
(74) *Attorney, Agent, or Firm* — Oblon, McClelland, Maier & Neustadt, L.L.P.

(57) ABSTRACT

In a method for supplying cooling water to a condenser under conditions where an evaporation rate of the cooling water is low during a certain time and is higher during other times, cooling water is delivered from a body of water underlying a cooling tower to the condenser. During the certain time when the evaporation rate of the cooling water is low, a level of the water in the body of water is controlled to a value such that a concentration of a contaminant in the body of water is low, and such that the temperature of the water in the body of water throughout the other times will assure a desired condensate temperature in the condenser throughout the other times. Then, a level of the water in the body of water during the other times is controlled to a value maintaining the low concentration of a dissolved solid and ions.

13 Claims, 4 Drawing Sheets

(51) Int. Cl.

| | |
|---|---|
| ***F28F 27/00*** | (2006.01) |
| ***F28B 9/06*** | (2006.01) |
| ***F28F 25/00*** | (2006.01) |

(56) References Cited

U.S. PATENT DOCUMENTS 4,813,240 A * 3/1989 Hon ..... F28F 25/00 261/DIG. 46
4,834,955 A * 5/1989 Mouche ..... B01D 53/502 252/180
5,273,687 A * 12/1993 Osborne ..... F28C 1/02 261/111
5,342,510 A * 8/1994 Eden ..... B01J 19/0006 204/433
5,660,042 A * 8/1997 Bronicki ..... F01D 15/10 60/641.2
5,751,599 A * 5/1998 Bortnik ..... F28F 19/00 700/274
5,839,282 A * 11/1998 Bronicki ..... F01D 15/10 60/641.5
6,740,231 B1 * 5/2004 Bauman ..... C02F 5/025 210/139
8,444,118 B1 * 5/2013 Dumler ..... F28C 1/00 261/26
2005/0036903 A1 * 2/2005 Colclasure ..... G01N 33/1853 422/14
2005/0067151 A1 * 3/2005 Miller ..... B01D 1/2846 165/108
2011/0314818 A1 * 12/2011 Breen ..... F01K 9/003 60/676
2013/0174913 A1 * 7/2013 Dinnage ..... F28F 25/02 137/2
2013/0218483 A1 * 8/2013 Sawyer ..... F28F 27/003 702/35

OTHER PUBLICATIONS

International Preliminary Report on Patentability and Written Opinion dated Jun. 15, 2017 in PCT/IB2015/002268.

* cited by examiner

COOLING WATER SUPPLY SYSTEM AND METHOD

FIELD OF THE INVENTION

The present invention relates to the field of industrial plants, more specifically to the field of cooling systems for such industrial plants. More particularly, the invention relates to a cooling system for power plants such as a cooling water supply system for power plants that provides effective cooling even for the hot summer months.

BACKGROUND

An important consideration of industrial plant designers wherein the industrial plants uses a cooling systems having a cooling tower is the temperature of the condensate. In such industrial plants e.g. power plants, by decreasing the condenser temperature, the turbine exhaust pressure is able to be decreased, and therefore the output of the power plant is able to be increased.

Many power plants that are not accessible to an abundant supply of natural cooling water rely on cooling towers to provide their cooling needs. In a typical circulation circuit involving a cooling tower, the cooling water (CW) flows through a condenser, in which it is heated due to the condensation of turbine exhaust, is then injected to a cooling tower for recooling, and is finally pumped back to the condenser. The CW introduced into the cooling tower is cooled by an upwardly flowing draft of air, primarily through evaporative cooling, and is then collected in an underlying reservoir, which will be referred to hereinafter as a "basin".

Since heat exchange in a cooling tower is accomplished by the evaporation of a portion of the CW, such that the latent heat of vaporization in the remaining portion of the CW required to cause the phase change is removed while providing the cooling effect, a supply of make-up water is needed to supplement the amount of water lost due to evaporation.

During the course of a hot summer day, the temperature of the water in the basin steadily increases as a result of the increased temperature of the ambient air. Likewise the temperature of the make-up water also increases as it is introduced into the basin and is mixed with the water. Due to this temperature increase, the condenser temperature is also increased, and therefore the output of the power plant is decreased. Consequently, the efficiency of the cooling system decreases.

Another important consideration of a cooling water supply system is the quality of the CW. As a result of CW evaporation from the cooling tower, dissolved solids such as calcium and magnesium salts, polymerized and non-polymerized silica as well as ions such as chlorides (and others depending on the water quality) are left behind. During the course of the day when more water evaporates, the concentration of dissolved solids and ions increases. If the concentration becomes excessive, scale and corrosion could form on surfaces of the cooling tower and of other components of the cooling water supply system, reducing heat transfer and adding maintenance costs to the system.

The accepted way of preventing the occurrence of an excessive concentration of dissolved solids and ions is by blowdown, whereby a portion of the CW together with dissolved solids and ions is continuously extracted from the basin and wasted. The extracted water is replaced by relatively clean make-up water to reduce the concentration of dissolved solids and ions while maintaining a substantially constant water level within the basin. In order to maintain a substantially constant water level within the basin, the blowdown pump adapted to extract dissolved solids and ions within the CW and the make-up pump for delivering the make-up water are operated in order to maintain a constant level in the basin. When using manual control, the risk of poor control of the supply of makeup water, supplied by the make up pumps, and extracting blow down, extracted by blow down pumps, all day long, including the hot hours, is greater such that the chance that make up well pumps as well as blow down pumps operate inaccurately so that scaling may result increases.

It is an object of the present invention to provide a cooling water supply system that minimizes increase of the condenser temperature during the hot summer months.

It is an additional object of the present invention to provide a cost effective cooling water supply system.

It is yet another object of the present invention to provide a cooling water supply system that increases the longevity of the blowdown pump and the make-up pump, relative to prior art systems.

It is yet a further object of the present invention to provide a cooling water supply system that is more effective in saving water than prior art systems.

Other objects and advantages of the invention will become apparent as the description proceeds.

SUMMARY

The present invention provides a cooling water supply system, comprising a condenser for cooling working fluid of a facility to a predetermined temperature; a cooling tower into which is injectable heated cooling water that has exited said condenser, for reducing the temperature of said heated cooling water primarily through evaporative cooling; a basin beneath said cooling tower, for receiving a non-evaporated portion of said heated cooling water discharged from said cooling tower; and flow control equipment for varying the level of a fluid characteristic of a water body of said cooling water within said basin, wherein said body of water, after achieving a predetermined low level of water fluid characteristic by said flow control equipment, remains at a sufficiently low temperature throughout a subsequent predetermined time period to generate a desired condensate temperature by a portion thereof that is delivered to said condenser, even when mixed with said cooling tower discharge which is of a higher temperature than the temperature of said body of water.

In one aspect, the temperature of the body of water within the basin is sufficiently low to generate a condensate temperature of less than a maximum predetermined value, which may be of a substantially same value throughout the year even when the average daytime temperature is greater than about 80° F.

In one aspect, the flow control equipment comprises one or more water level sensors for detecting the water level within the basin, a blowdown flow component for extracting cooling water together with dissolved solids and ions from the basin, and a make-up flow component for adding water to the basin from a water source to compensate for lost water detected by said one or more water level sensors.

In one aspect, in addition, the flow control equipment for detecting the water level within the basin further comprises a sensor for detecting a fluid characteristic value, such as the electric conductivity of the water in the basin so that a blowdown flow component for extracting cooling water together with dissolved solids and ions from the basin, and a make-up flow component for adding water to the basin from a water source can compensate for lost water detected by said one or more water level sensors.

In one aspect, the make-up flow component is activatable to produce a variable flow when evaporation rates of water are at or approximately equal to a minimum value, in order to raise the water level of the body of water to a predetermined value at the beginning of a time period that is characterized by increasing evaporation rates.

In one aspect, the flow control equipment further comprises a controller for receiving signals generated by each of the sensors that are representative of a detected water level and for controlling the blowdown flow component and/or the make-up flow component in response to said received signals.

In one aspect, the flow control equipment controls the blowdown component and the make-up pump(s) or control valve also in response to data relating to the cooling water, water level and water characteristic.

In one aspect, the make-up flow component is controlled by the controller to produce a variable flow when evaporation rates of water are at or approximately equal to a minimum value, in order to lower the fluid characteristic value e.g. the electric conductivity level of the body of water to a predetermined value at the beginning of a time period that is characterized by increasing evaporation rates.

In one aspect, the make-up flow component is controlled by the controller to operate during a plurality of discrete intervals, in response to the fluid characteristic value level readings e.g. monitored electric conductivity level readings of the water within the basin.

The present invention is also directed to a method for supplying cooling water to a condenser, comprising the steps of achieving a low fluid characteristic level, during a time period when evaporation rates of water are at a lowered value, of a body of water within a basin underlying a cooling tower and from which cooling water is delivered to a condenser for cooling working fluid of a facility; and maintaining said low fluid characteristic level of said body of water prior to or at the beginning of a further time period, that is characterized by increasing evaporation rates, as well as controlling the characteristic fluid level of said body of water during said further time period, characterized by increasing evaporation rates, so that said body of water remains at a sufficiently low temperature throughout said further time period to generate a desired condensate temperature by a portion thereof that is delivered to said condenser, even when mixed with cooling tower discharge which is of a higher temperature than the temperature of said body of water.

In one aspect, the water level readings are carried out by a water level meter and the fluid characteristic of the water in the basin e.g. the electric conductivity of the water in the basin is measured by an electric conductivity meter so that when taking into consideration the limits of the desired electric conductivity values and water level value, the predicted fluid characteristic value e.g. electric conductivity value of dissolved solids and ions in the body of water for the level of water and volume of water is achieved by adjusting the volume of the body of water by controlling the blow down flow and controlling the makeup flow.

BRIEF DESCRIPTION OF THE DRAWINGS

In the drawings.

Similar reference numerals indicate similar components.

DETAILED DESCRIPTION

In the cooling water supply system of the present invention, the water level in the cooling tower basin is increased during nighttime hours or at any other selected time period to a height that is sufficient to provide the cooling needs during the course of the day. The water in the basin is cooled in the cooling tower during nighttime hours, and therefore functions such that it remains at a sufficiently low temperature to achieve a desired condensate temperature even when mixed with the warmer CW discharge from the cooling tower.

The term fluid characteristic used herein is a characteristic of the water in the cooling tower basin providing, according to the present invention, an indication of the concentration of the solids and ions present in the water in the basin. Additionally, a fluid characteristic sensor is, according to the present invention, a sensor for measuring a fluid characteristic of the water in the cooling tower basin for providing an indication of the concentration of the solids and ions present in the water in the basin.

Figure 1:
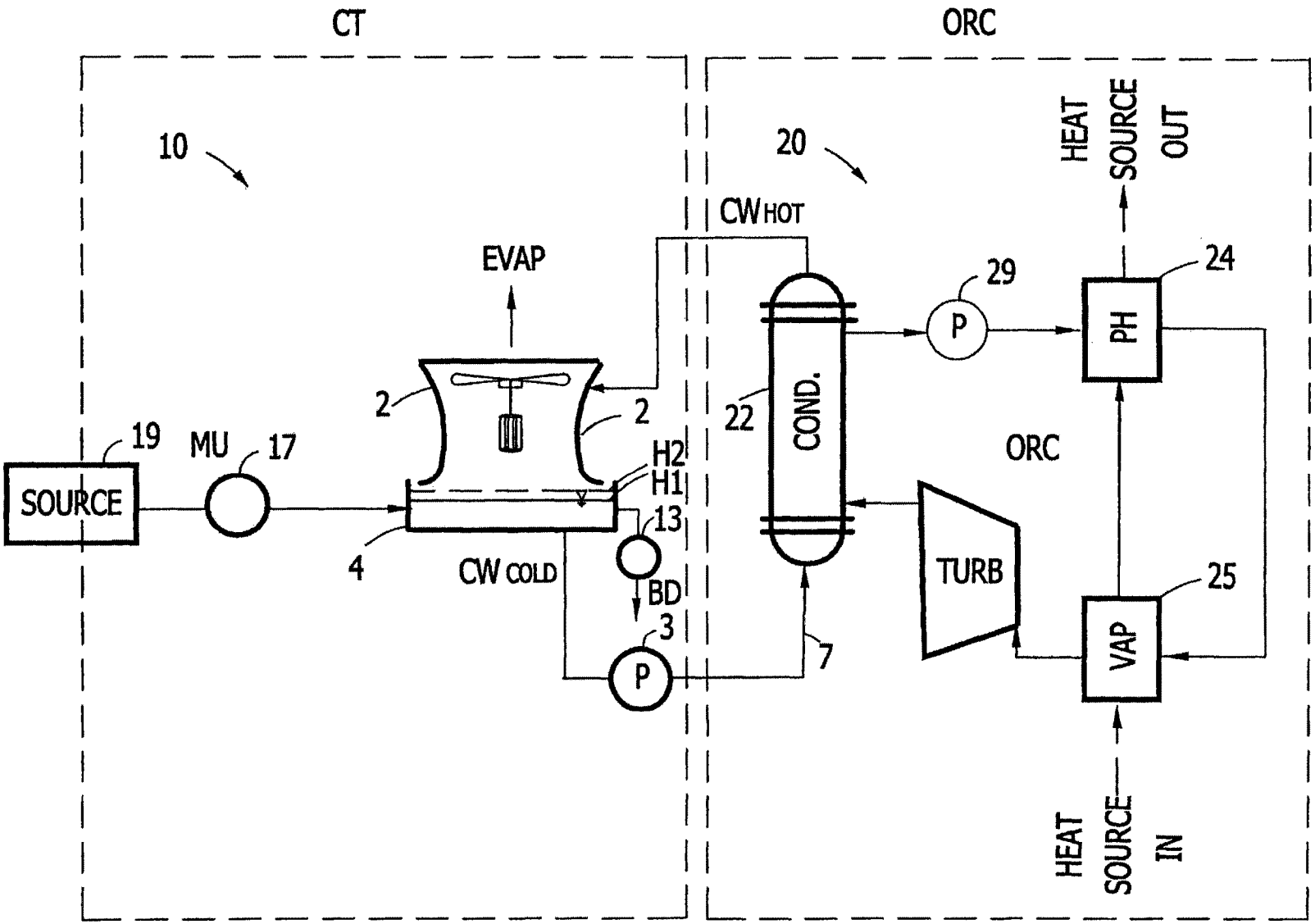
FIG. 1 is a schematic illustration of a cooling water supply system, according to one embodiment of the present invention.

FIG. 1 schematically illustrates a cooling water supply system, generally indicated by numeral 10, according to one embodiment of the present invention. Cooling water supply system 10 is shown to deliver the CW from basin 4 located near the bottom of cooling tower 2 at a sufficiently low temperature to cool the working fluid flowing in Organic Rankine Cycle (ORC) circuit 20 of a power plant, sequentially from condenser 22, advantageously preheater 24, vaporizer 25 and vapor turbine 26. The organic working fluid expands in vapor turbine 26 to produce power, and then exits vapor turbine 26 and flows to condenser 22, from which the organic working fluid condensate produced is supplied by pump 29 to advantageously preheater 24 and vaporizer 25. A heat source supplies the required heat influx for advantageously preheating and vaporizing the working fluid advantageously at preheater 24 and vaporizer 25, respectively.

It will be appreciated that the CW is likewise capable of cooling the working fluid of any other power cycle, or the working fluid of any other process plant.

Cold CW is delivered by circulation pump 3 via conduit 7 to condenser 22 of ORC power plant circuit 20, for cooling the organic working fluid to a predetermined temperature needed to achieve a desired power output. In condenser 22, the CW is in heat exchange relation with the working fluid and becomes heated and the heated CW exiting condenser 22 is delivered near to, or at the top of, cooling tower 2, where it is injected into a stream of air flowing within the interior of the cooling tower by sprinklers or nozzles, or by any other means well known to those skilled in the art.

Cooling tower 2 may be of any suitable type, such as a natural draft cooling tower and a forced draft cooling tower, and the air flow therein may be of any desired design advantageously such as counterflow or cross flow to the direction of the falling non-evaporated water.

As a result of interaction with the air stream, a portion of the CW is lost to the ambient air by evaporation, and to a certain extent by drift or entrainment of water droplets in the air stream, as well as to a certain extent by loss of water due to wind blowing through the cooling tower.

The remaining portion of the water falling within the cooling tower is collected within basin 4, and is cooled, relative to the heated CW exiting condenser 22, primarily by evaporation of the heated CW.

A considerable amount of solids and ions are dissolved in the non-evaporated CW that has flown through cooling tower 2 and collected in basin 4. Since the concentration of the dissolved solid and ions within the CW can increase following recirculation within system 10, and could possibly eventually reach scale or corrosion forming concentrations, blowdown (BD) flow component or flow control means such as blowdown (BD) pump 13 is operated to extract a portion of the CW from basin 4 and to thereby lower the dissolved solid and ion concentration. Alternatively, a portion of the CW is bled by other flow control means well known to those skilled in the art, such as by a blowdown valve.

In order to supplement the amount of lost CW as a result of evaporation, drift, wind and blowdown, make-up water (MU) flow component or flow control means such make-up water (MU) pump or MU control valve 17 is operated so that a predetermined amount of water will be delivered to basin 4 from a water source 19, which may be a underground aquifer, pond, river, other local water source or an external storage member.

As opposed to prior art cooling water supply systems wherein the water level within the basin is maintained at a substantially uniform or fixed level and therefore the CW significantly increases during the day, the water level in basin 4 is variable, being changed in response to certain factors or considerations or to ambient weather conditions. When adding make-up water of an amount greater than the BD flow and evaporation rate, the water level in basin 4 progressively increases by a value of $\Delta h$ from $h_1$ to $h_2$. Thus, the temperature of the CW within the basin is sufficiently reduced during daytime hours, which is characterized by a period of increased CW evaporation within the cooling tower, so that, even when non-evaporated cooling tower discharge is collected in basin 4 and may cause a slight increase of the water temperature in the basin, the CW will still be able to cool the organic working fluid in condenser 22 to less than a maximum predetermined condensate temperature. Thus, system 10 will be able to cool the organic working fluid to less than a maximum predetermined condensate temperature even during hot summer days when the average daytime temperature can be greater than about e.g. 80° F.

Figure 2:
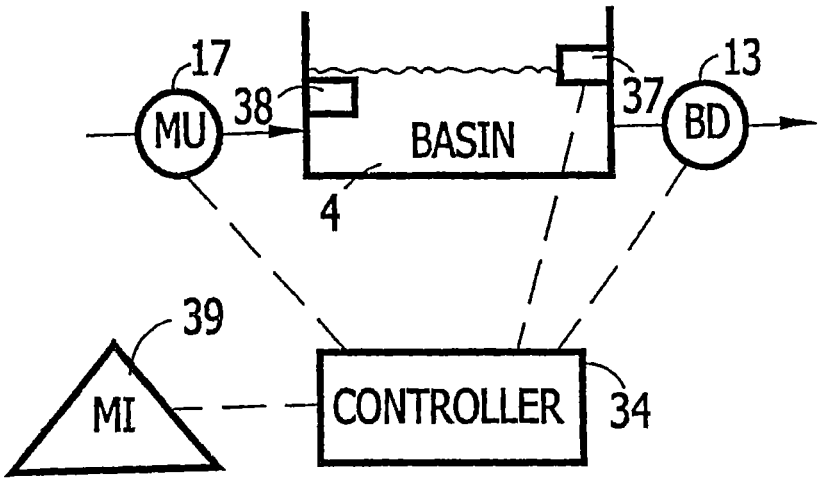
FIG. 2 is a schematic illustration of flow control equipment used to control the water within the cooling tower basin according to one embodiment of the present invention.

FIG. 2 schematically illustrates an embodiment of flow control equipment used to control the water within the basin. Flow control equipment 32 comprises one or more water level sensors 37 for detecting the water level within basin 4, fluid characteristic detecting means 38, such as electric conductivity meter or other means for detecting a water characteristic, advantageously a meteorological indicator 39, BD flow component or flow control means, such as BD pump or valve 13 and MU flow component or flow control means, such as MU pump or valve 17. Controller 34 receives signals generated by each sensor 37 and sensor 38 that are representative of the detected water level and electric conductivity level or concentration level of chemical species, and in response suitably controls BD pump or valve 13 and MU pump or valve 17. Controller 34 may also control operation of BD pump 13 and MU pump 17 advantageously in conjunction with a meteorological indicator (MI) 39.

Level sensor 37 may be meter for measuring the fluid level within the basin providing an indication of the water level in the basin.

Fluid characteristic sensor 38. e.g. an electric conductivity meter for measuring the electrical conductivity of the water within the basin, provides an indication of the concentration of dissolved solids and ions in the water.

It will be appreciated that BD flow component or flow control means, such as BD pump or valve 13 and MU flow component or flow control means, such as MU pump or valve 17 may be manually operated in response to a water level indication as well as in response to the electric conductivity value sensed by conductivity meter 38. Alternatively, BD flow component or flow control means, such as BD pump or valve 13 and MU flow component or flow control means, such as MU pump or valve 17 may be automatically operated in response to a water level indication provided by water level sensors 37 as well as in response to the electric conductivity value sensed by conductivity meter 38.

For example, in one embodiment, MU pump or control valve 17 is operated at a time when CW evaporation rates are at or approximately equal to a relative minimum value, such as during nighttime hours or early morning hours. Consequently, the water depth or height in the basin increases and thus reaches a predetermined value at the beginning of a time period that is characterized by increasing evaporation rates, such as daytime hours. In such a manner, the amount of make-up water added to basin 4 is such that it substantially ensures the amount of water in the basin is sufficient to cover the water losses anticipated to be lost from the CW during a subsequent period of increasing evaporation rates, including evaporation losses, blowdown losses, possible drift losses, and possible wind losses. Thus, the volume and temperature of CW within the basin are sufficient to ensure that the condensate temperature will be less than the designed temperature, which may be of a same value throughout the year or may vary, depending on the heat load, ambient temperature, or other factors.

The evaporation losses, possible drift losses, and possible wind losses may be estimated empirically from past cooling tower performance, or alternatively may be calculated, for example by means of controller 34, from data received from meteorological indicator 39. Meteorological indicator 39 may provide data such as ambient temperature and relative humidity that is related to the previous day's reading or a forecasted value of the upcoming day.

In addition, BD pump or control valve 13 may be operated during daytime hours while monitoring the water level and electric conductivity level of the water in basin 4 when evaporation rates of the CW are increased and the concentration of dissolved solids and ions within the CW can increase, as shown by the monitoring of water level sensors 37 and electric conductivity meter 38, at a rate that will ensure that the dissolved solid and ion concentration will be less than a scale or corrosion forming value. Alternatively, BD pump or control valve 13 may be operated for a specific period of time while monitoring the water level or e.g. electric conductivity level of the water in basin 4 for ensuring that the dissolved solid and ion concentration will be less than a scale or corrosion forming value.

In another embodiment, MU pump or control valve 17 is operated or opened to a certain percentage, respectively, for producing a changing MU flow rate, during the course of the day while monitoring the water level and electric conductivity level of the water in basin 4. For example, the first make-up supplying operation can be performed at a time when CW evaporation rates are at or approximately equal to a minimum value. The other make-up supplying operations are performed during periods of increased evaporation rates, in response to monitored water level readings within the basin. Also here, BD pump or control valve 13 may also be operated or opened at a certain percentage, respectively, for producing a changing MU flow rate during the day while the concentration levels of the dissolved solids and ions are being continuously monitored. Thus, the water level within the basin may be accurately controlled while ensuring that the condensate temperature will be maintained at less than the designed temperature.

By operating BD pump 13 and MU pump 17 as previously described, it will be ensured that they are not overloaded or burned out, and therefore their life span can be increased.

Figure 3:
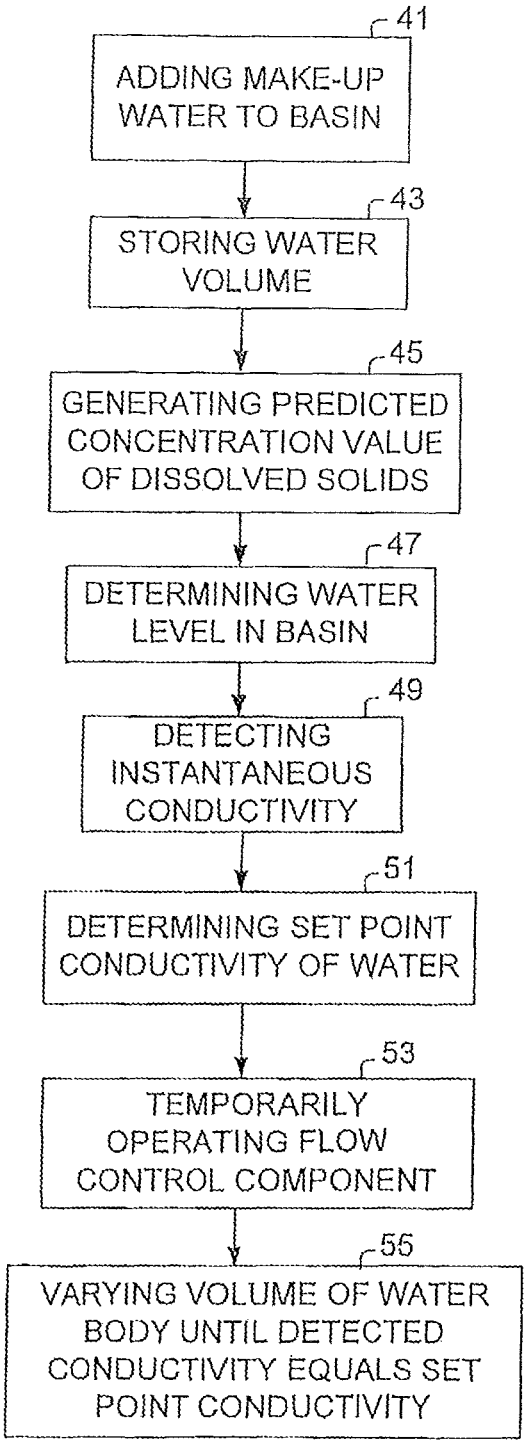
FIG. 3 is a method for determining the water level in the cooling tower basin with use of a fluid characteristic sensors such as an electric conductivity meter.
Figure 4:
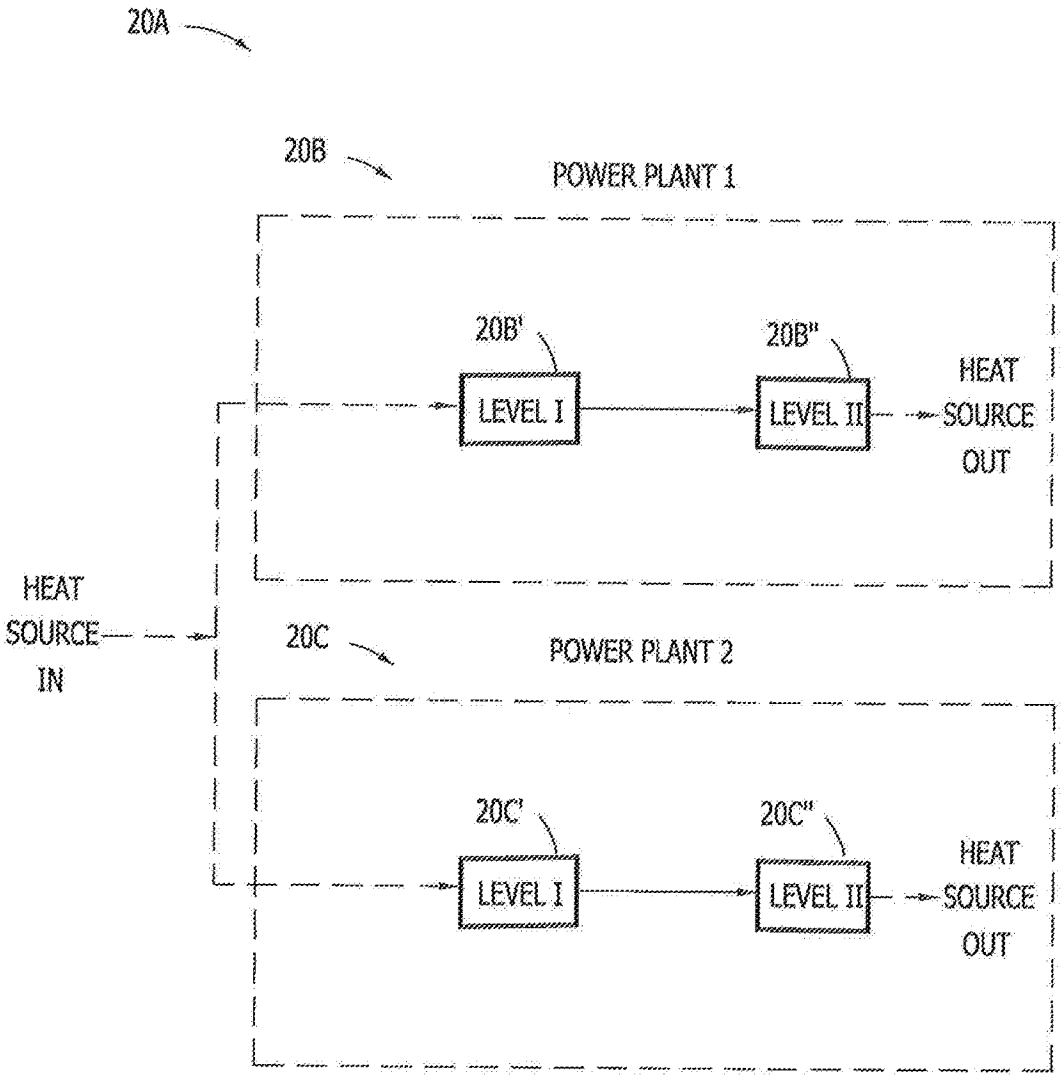
FIG. 4 illustrates two, two level power plant units.

FIG. 3 illustrates a method for determining the water level and concentration of dissolved solids and ions in the water in the basin advantageously using e.g. an electric conductivity meter, adapted to monitor the concentration of dissolved solids and ions since the concentration is proportional to the electrical conductivity of the water. Alternatively, other sensors for other fluid qualities may be used.

Since prior art cooling water supply systems maintain a fixed or uniform water level in the basin, they are able to control the dissolved solid and ion concentration, if differing from an anticipated value, by adding make-up water to the basin or extracting a quantity of the water through a blowdown line. However, as far as the cooling water supply system of the present invention is concerned in which the water level is varied within the basin as described herein, an indication of the dissolved solid and ion concentration would seemingly not be a beneficial control parameter for controlling or maintaining the water level and/or the dissolved solid and ion concentration level since it is unknown whether the concentration is below a permissible limit and the present water level is relatively high, or whether the concentration is excessive and the present water level is relatively low.

When monitoring the dissolved solid and ion concentration in the cooling water, an advantageously electronically controlled make-up pump or valve can be operated to add a desired amount of relatively cool water to the basin in step 41. The controller controls the operation of the pump motor or valve as well as to operate for a predetermined duration or periods of time. Since data related to a nominal pump capacity is stored in a memory device of the controller, the controller in step 43 can determine the amount of make-up water that was added. If the basin is partially filled as a result of operation of the cooling water supply system in a previous monitoring period, the volume is equal to the sum of the volume of the added make-up water and the volume of the water in the basin at the previous monitoring period. The method for determining the volume will be described hereinafter.

During the monitoring period, the level meter determines, in step 47, the level or height of water in basin 4 and e.g. the electric conductivity meter detects the instantaneous electric conductivity of the water body within the basin in step 49. The set point electric conductivity is then determined for the water level in step 51. If the controller determines that the detected electric conductivity differs from the set point, the make-up pump or make-up control valve, or, advantageously the blowdown pump or blowdown control valve, or advantageously any other blowdown flow component, is temporarily operated in step 53. The flow control component may be operated for a discrete time period or periods in step 55 in order to vary the volume of the water body within the basin until the detected electric conductivity is equal to the set-point electric conductivity.

In this manner, the advantageously electronically controlled make-up pump or flow component and blowdown flow component need not be operated continuously, yet the concentration of dissolved solids and ions is able to be monitored to ensure that it will be below a scale or corrosion forming value even if water losses are different than anticipated. This control of the dissolved solid and ion concentration occurs while the temperature of water within the basin is maintained at a sufficiently low average temperature throughout the monitoring period, due to its relatively high volume, to generate a desired condensate temperature.

If an external storage member is also used, reduction in the concentration of dissolved solids is simplified as the concentration of water in the external storage member is generally considerably lower than that in the basin.

Furthermore, it is to be pointed out that while, herein, the term fluid characteristic e.g. electric conductivity as well as equipment for measuring the fluid characteristic e.g. electric conductivity meter is mentioned, other fluid characteristics such as opacity, ORP (oxidative redox potential), optical density, refractive index, pH, density, viscosity, corrosion potential, or discrete chemical laboratory results (being fed to the controller) etc., and suitable sensors can, according to the present invention, be alternatively used for providing an indication of the concentration of the solids and ions present in the water in the basin. For example, in the geothermal power plant in Tuscarora, Nev. correlation between the level of electric conductivity of the water in the basin and the concentration of polymerized and non-polymerized silica in the water in the basin has been found.

Moreover, while herein, the present invention is described as referring to a cooling system using water as the cooling medium for use in a water-cooled condenser, in accordance with the present invention, the present invention can also be used in an air-cooled condenser system, wherein evaporative cooling or fogging can be carried to further cool the working fluid vapor/condensate flowing in the conduits of the air-cooled condenser as described in U.S. Pat. No. 8,601,814, the disclosure of which is incorporated by reference. In such a system, water is sprayed in the vicinity of the air-cooled condenser conduits so that evaporative cooling or fogging of the sprayed water or water droplets further cools the working fluid vapor/condensate flowing in the air-cooled condenser conduits. In such a system, a basin similar to the one described herein can be used to collect water that is not evaporated for further use. By controlling the level of the water in such a basin as described herein, effective cooling of the working fluid vapor/condensate flowing in the air-cooled condenser conduits can be achieved even during periods of hot weather such as during summer days. In this embodiment, the water used can be supplied from an underground aquifer or pond, river, or other local water source or an external storage member, as described herein, or even from the geothermal fluid itself, such as that described in the above-mentioned U.S. Pat. No. 8,601,814.

In addition, while herein, the present invention is described as referring to a cooling system using water as the cooling medium, in accordance with the present invention, the cooling water supply system of the present invention can be used together with an air cooled condenser system e.g. as described with reference to FIG. 6 in U.S. Pat. No. 5,660,042, the disclosure of which is incorporated by reference, so that hybrid cooling can be achieved, in accordance with the present invention, by such a cooling system.

Additionally, even though herein, an Organic Rankine Cycle power plant, such as a geothermal Organic Rankine Cycle power plant, is mentioned for use with the invention presently described herein, in accordance with the present invention, other power plants, such as steam power plants, e.g. geothermal steam power plants, and combined geothermal power plants, etc. having a cooling tower and basin associated with the condenser of such power plants can also be used in the present invention.

Example

The effectiveness of the cooling water supply system was tested on Jul. 12, 2014 at a geothermal ORC power plant in Nevada, U S. A., producing about 17 MW net power. The power plant has two power plant units, each of which have two levels. For a cooling tower height of about 27.5 ft, the underlying basin has an area of 20,584 square feet and a height of about 5 ft. The maximum height, or the 100% value, was set at a height of 4.6 ft, corresponding to a water volume of 708,500 gallons.

The water level of the basin in the early morning was raised to 78% (1050 μSiemens/cm or μS/cm electric conductivity value or level, equivalent to 296 ppm $SiO_2$ at Tuscarora, Nev., U.S.A) and was lowered to 58% (1150 μSiemens/cm or μS/cm electric conductivity value or level, equivalent to 329 ppm $SiO_2$ at Tuscarora, Nev., U.S.A) of the maximum height in the evening due to increased evaporation. CW at a temperature of about 68.9° F. was circulated to the power plant condensers at a flow rate of 66,096 gpm. Make-up water was supplied to the basin at a rate of 1400 gpm, while about 400 gpm was extracted through the blowdown line.

The condensate temperature was as follows: at Power Plant 1, Level 1 the inlet temperature was 137° F. and the outlet temperature was 93.3° F., at Power Plant 1, Level 2 the inlet temperature was 138.6° F. and the outlet temperature was 88.5° F., at Power Plant 2, Level 1 the inlet temperature was 139° F. and the outlet temperature was 93.3° F., and at Power Plant 2, Level 2 the inlet temperature was 132° F. and the outlet temperature was 87.8° F. The temperature of the CW exiting the condensers and supplied to the cooling tower was 80.2° F.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A method for supplying cooling water to a condenser under conditions where an evaporation rate of the cooling water is a low value during a certain period of time in each day and is higher than the low value during other periods of time in each day, comprising the steps of:

providing a water reservoir within a basin underlying a cooling tower;

delivering the cooling water from the water reservoir to the condenser for cooling working fluid of a facility;

controlling a height of the cooling water in the water reservoir, during the certain period of time when the evaporation rate of the cooling water is low, to be a variable water level that is varied based on ambient temperature conditions, such that a temperature of the cooling water in the water reservoir throughout said other periods of time will assure a predetermined condensate temperature of the working fluid, or a temperature lower than the predetermined temperature, in the condenser throughout said other periods of time; and controlling the height of the cooling water in the water reservoir during the other periods of time at a value for maintaining a concentration of a dissolved solid and ions that is lower than a predetermined value.

2. The method according to claim 1, wherein the step of controlling the height of the cooling water in the water reservoir during the other periods of time comprises operating a flow control component in response to monitored cooling water height readings within the basin.

3. The method according to claim 1, wherein the step of controlling the height of the cooling water in the water reservoir during the other periods of time comprises operating a flow control component in response to monitored electric conductivity values or readings carried out by an electric conductivity meter for detecting electrical conductivity of the cooling water within the water reservoir.

4. The method according to claim 2, wherein the cooling water height readings are carried out by:

a) storing a value indicating a volume of cooling water in the water reservoir;

b) generating a predicted concentration value of dissolved solids and ions in the water reservoir;

c) determining an electrical conductivity of the cooling water in the water reservoir corresponding to said value indicating the volume of cooling water in the water reservoir;

d) detecting an instantaneous electric conductivity of the cooling water within the water reservoir by an electric conductivity meter;

e) varying the volume of the cooling water in the water reservoir until a detected value of the instantaneous electric conductivity of the cooling water in the water reservoir is substantially equal to a starting electric conductivity of the cooling water in the water reservoir;

f) detecting a change in volume during step (e); and g) obtaining a value indicating the volume of cooling water from said detected change in value indicating a change of volume and a previous value indicating a previous detected volume of cooling water in the water reservoir.

5. The method according to claim 1, wherein the condenser is in an Organic Rankine Cycle power plant.

6. The method according to claim 5, wherein the condenser is in a geothermal power plant.

7. The method according to claim 1 wherein the cooling water supplied to said condenser is supplied to the condenser which is part of an organic Rankine cycle power plant.

8. The method according to claim 7 wherein the method further comprises operating said condenser of said organic Rankine cycle power plant together with an air-cooled condenser in said organic Rankine cycle power plant.

9. The method according to claim 8 wherein the method further comprises operating said condenser of said organic Rankine cycle power plant, wherein the organic Rankine cycle power plant comprises two power plant units.

10. The method according to claim 9 wherein the method for operating said condenser of said organic Rankine cycle power plant comprises operating the condenser of each of said two power plant units, whereby the method operates the condenser of each power plant unit comprising a two level power plant unit.

11. The method according to claim 1 wherein said certain period of time when the evaporation rate of the cooling water is low is night time.

12. The method according to claim 1 wherein said other periods of time include day time.

13. The method according to claim 1 wherein said other periods of time include day time on hot summer days.

* * * * *